United States Patent [19]

Van Royen

[11] 4,028,108

[45] June 7, 1977

[54] FREE-RADICAL PHOTOGRAPHIC MATERIAL

[75] Inventor: Freddy Ghisleen Van Royen, Ranst, Belgium

[73] Assignee: AGFA-GEVAERT N.V., Mortsel, Belgium

[22] Filed: Nov. 10, 1975

[21] Appl. No.: 630,496

[30] Foreign Application Priority Data

Nov. 12, 1974 United Kingdom ..... 48943/74

[52] U.S. Cl. ..... 96/48 R; 96/48 QP; 96/90 R; 96/90 PC; 96/115 P

[51] Int. Cl.[2] ..... G03C 5/24; G03C 1/52

[58] Field of Search ..... 96/90 R, 90 PC, 115 P, 96/48 R, 48 QP, 119 QP

[56] References Cited

UNITED STATES PATENTS

| | | | |
|---|---|---|---|
| 3,351,467 | 11/1967 | Sprague et al. | 96/90 R |
| 3,525,616 | 8/1970 | Hackmann et al. | 96/90 R |
| 3,697,276 | 10/1972 | Lewis et al. | 96/90 R |
| 3,773,515 | 11/1973 | Yamashita et al. | 96/90 R |
| 3,810,762 | 5/1974 | Laridon et al. | 96/90 PC |
| 3,920,457 | 11/1975 | Cunningham et al. | 96/90 R |

*Primary Examiner*—Won H. Louie, Jr.

*Attorney, Agent, or Firm*—William J. Daniel

[57] ABSTRACT

A photographic process in which a photographic material containing in a layer on a support a mixture of the following compounds:

1. at least one ultraviolet-sensitive organic polyhalogen compound capable of producing a dye salt with a spiropyran compound on exposure with ultraviolet radiation,
2. at least one spirobi(arylpyran) compound,
3. N-vinylcarbazole,
4. at least one compound selected from the group consisting of furan, furylacrylic acid and 2-carboxyfuran,
5. at least one compound selected from the group consisting of 1-phenyl-3-pyrazolidinone, benzalphenylhydrazone and 1,5-dimethyl-2-phenyl-4-pyrazolin-3-one, and
6. a polymeric compound containing N-vinylcarbazole units, is image-wise exposed to ultraviolet radiation of an intensity sufficient to produce a print-out image and the exposed material is heated to stabilize the image and to increase its spectral density in the three primary color spectral regions.

11 Claims, 1 Drawing Figure

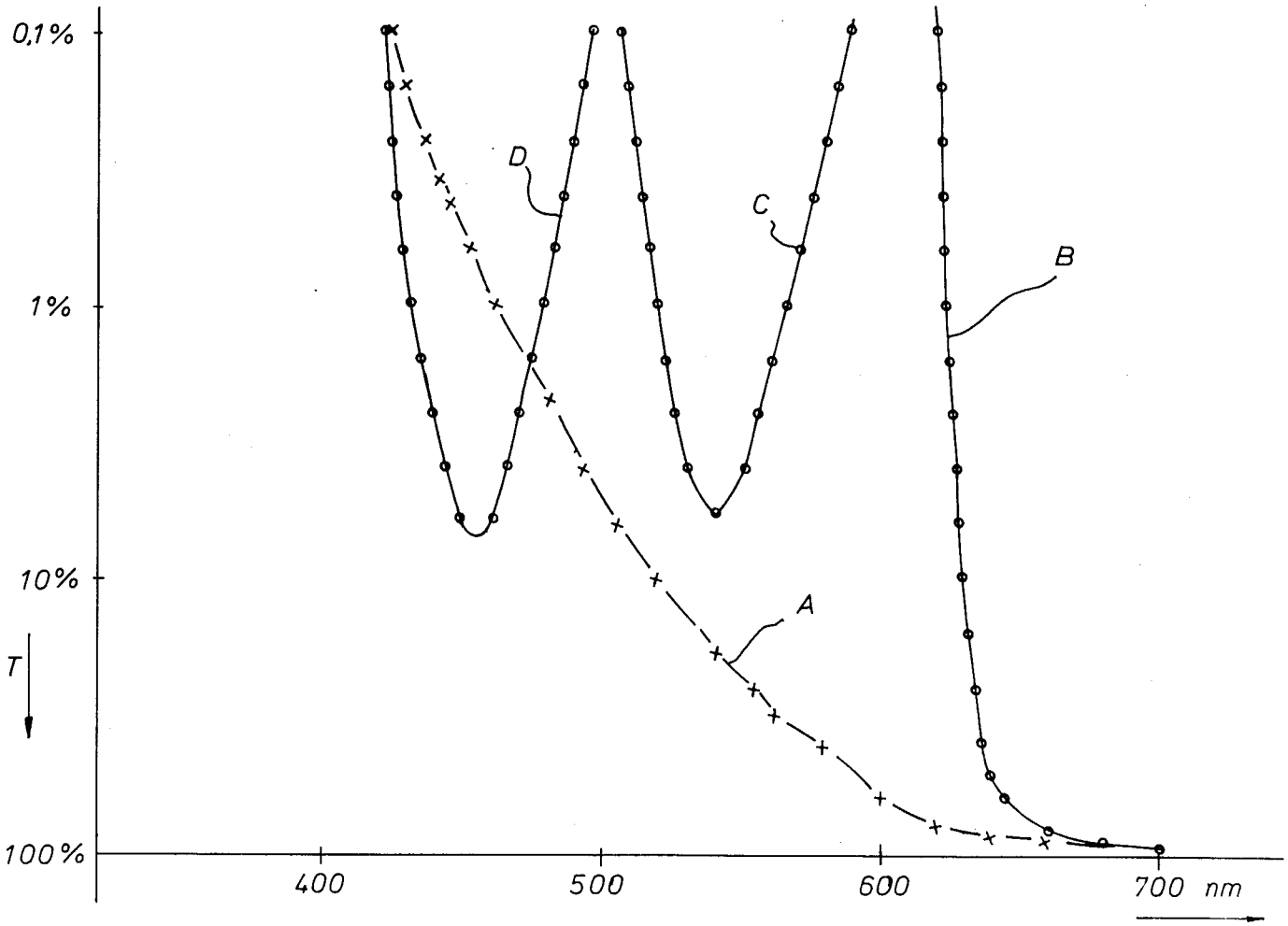
0,1%
1%
10%
100%
T
400
500
600
700 nm
A
B
C
D

FREE-RADICAL PHOTOGRAPHIC MATERIAL

The present invention relates to photographic materials and a process for forming visible images in which the image formation is based on the use of a photosensitive polyhalogen compound and dye precursor compounds.

A free-radical photographic dye-forming system based on the use of said polyhalogen compound and a dye precursor compound has been described, by R. A. Fotland in J. Phot. Sci., 18 (1970) 33-37, in the U.S. Pat. Nos. 3,102,810 — 3,147,117 — 3,377,167 — 3,525,616 — 3,558,317 — 3,598,583 and the United Kingdom Pat. Nos. 1,065,548 — 1,073,245 — 1,076,368 — 1,151,578 and 1,359,472. In the last mentioned patent specification a dye image formation process using carbon tetrabromide as photosensitive compound, a spiropyran as dye precursor compound and a polymer of N-vinylcarbazole as binding agent and sensitivity-enhancing compound is described. The obtained dye images is said process are absorbing light in only a portion of the visible spectrum and it has proved difficult with the spiropyrans as sole dye precursors to obtain dense neutral black images, which are required in the microfilm field.

In the examples of the U.S. Pat. No. 3,615,477 photosensitive materials for the production of black images are described.

The photosensitive materials producing black images contain a dimethoxyaniline as dye precursor compound together with a purified furfurylidene compound and as photosensitive compound a lower haloalkane such as iodoform.

Said photosensitive material needs rather long exposures with high intensity ultraviolet sources such as a carbon arc.

It is one of the objects of the present invention to provide photographic recording materials of improved speed that contain a photosensitive organic polyhalogen compound and a mixture of compounds capable of yielding on heating after image-wise exposure to ultraviolet radiation a substantially black image.

A photographic recording material according to the present invention contains in a layer on a support a mixture of the following compounds:

1. at least one ultraviolet-sensitive organic polyhalogen compound capable of producing a dye salt with a spiropyran compound on exposure with ultraviolet radiation,
2. at least one spirobi(arylpyran) compound,
3. N-vinylcarbazole,
4. at least one compound selected from the group consisting of 2-carboxyfuran, furan and furylacrylic acid having the following structure:

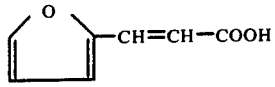

5. at least one compound selected from the group consisting of 1-phenyl-3-pyrazolidinone, benzalphenylhydrazone

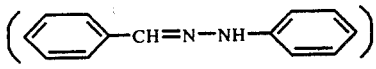

and 2,3-dimethyl-1-phenyl-5(2)-pyrazolone (antipyrine), and 6. a polymeric compound containing N-vinylcarbazole units.

The organic polyhalogen compounds used according to the present invention are capable of photolytically separating a halogen-containing free radical.

Said photosensitive polyhalogen compounds are within the scope of the following general formula:

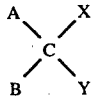

wherein:

each of A, B, X and Y is a halogen atom of the group of chlorine, bromine, or iodine, or wherein one of said symbols A, B, X or Y represents an alkyl group, including a substituted alkyl group, e.g., a halogen-substituted alkyl group, a hydroxyalkyl group or an aralkyl group, e.g., benzyl, an aryl group, a substituted aryl group or an aroyl group, and the other symbols chlorine, bromine or iodine, or wherein at least two of said symbols A, B, X or Y represent an aromatic acyl group, e.g., benzoyl, and the other symbols chlorine, bromine or iodine.

Preferred representatives falling within the scope of that general formula are carbon tetrabromide, bromoform and iodoform.

Particularly suited spiropyran compounds for use according to the present invention contain at least one pyran ring having in the ortho- and meta-positions with respect to the oxygen atom a condensed benzo or naphtho ring or other aromatic polycyclic ring system including these condensed rings or ring systems in substituted state, e.g., an anthraceno or a phenanthreno ring system, e.g., as present in a spirodibenzopyran, a spirodinaphthopyran, a spirobenzonaphthopyran, or such spiropyrans containing condensed aromatic nuclei of the anthracene or phenanthrene type.

In said spiropyrans the pyran rings and/or the condensed benzo and/or condensed higher atomatic rings may be substituted.

General formulae covering such spiropyrans are the following:

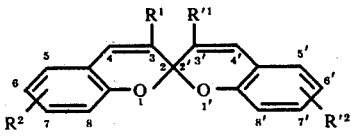

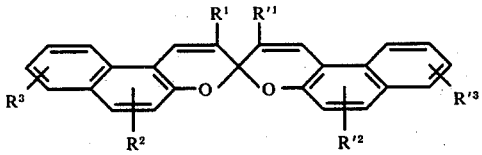

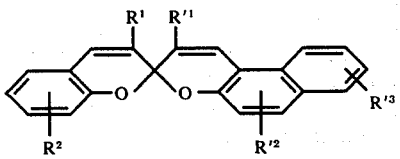

-continued

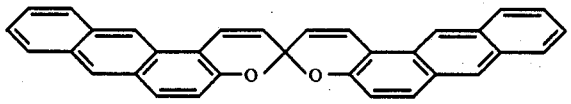

wherein:

each of $R^1$, $R'^1$, $R^2$, $R'^2$, $R^3$and $R'^3$ represents hydrogen, an aliphatic group including a substituted aliphatic group, e.g., a ($C_1$ – $C_{20}$) alkyl group including such an alkyl group in substituted form, e.g., methyl, ethyl, propyl, amyl or hexadecyl, an halogen-substituted alkyl group, an alkylene ester group, e.g., $—CH_2—COOC_2H_5$, alkyl substituted with a carboxyl group, e.g., $—CH_2—COOH$, an alkylene carbonamide group or such a group in which the carbonamide group is substituted with phenyl, e.g.,

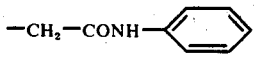

an acyl group, e.g., acetyl, halogen, nitro, hydroxy, an alkoxy or aryloxy group, a phenyl group or a substituted phenyl group, piperidyl, or $R^1$ and $R'^1$ together represent a $—(CH_2)_n$-chain wherein $n = 2$ or 3 to link the carbon atoms in the 3- and 3'-positions together.

Suited spiropyran compounds and their preparation are described in the published German Pat. Applications Nos. 1,274,655 filed Dec. 15, 1965 by Telefunken Patentverwertungs GmbH, 1,269,665 — 1,286,110 — 1,286,111 and 1,286,112 all filed Sept. 30, 1966 by Telefunken Patent-verwertungs GmbH, and by W. Dilthey, Berres, Holterkoff, Wubken, J. Prakt. Chem. [2], 114, 187 (1926), by C. F. Koelsch and W. R. Workman in J. Amer. Chem. Soc. 74, 6288 (1952) and by I. M. Heilbron and G. F. Howard In J. Chem. Soc. (1934), 1571.

An illustrative list of particularly useful spirobi (arylpryan) compounds is given in the U.S. Pat. No. 3,810,762.

In order to illustrate the preparation of spirobi(arylpyran)-compounds the preparation of 3-methyl-di-β-naphthospiropyran having the following structure:

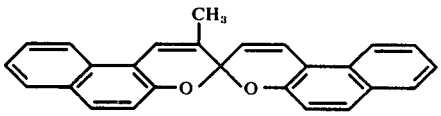

is given.

In a 2 liter three-necked flask, fitted with a reflux condenser and a gas inlet tube reaching nearly the bottom of the flask are introduced:

| | |
|---|---|
| ethanol | 1 litre |
| butanone | 22 ml (0.25 mole) |
| 2-hydroxy-1-naphthaldehyde | 86 g (0.5 mole) |

The flask is shaken until partial dissolution of the ingredients. Dry hydrogen chloride gas is introduced at a rate, which allows complete absorption and the start of ethanol reflux. Thereupon the already strongly blue colored mixture is cooled in a mixture of ice and sodium chloride and the introduction of hydrogen chloride gas is continued until saturation. In the reaction mixture green crystals of pyrylium salt form and the crystallization is allowed to proceed overnight in a refrigerator. The pyrylium salt formed is separated by suction, washed with ethanol and thereupon brought into suspension in 300 ml of ethanol. Whilst stirring, a 10% by weight aqeuous solution of ammonium hyroxide is added until the mixture is definitely alkaline. During that operation the mixture turns colourless. The obtained cyrstalline product is separated by suction, washed with water and dried. Finally the spiropyran compound is recrystallized from 600 ml of benzene and again separated and dried under reduced pressure at 50°–60° C.

Yield: 45 g.

Melting point: 204° C.

The homopolymer or copolymer containing N-vinylcarbazole units is used in an amount large enough to serve as binder for the other above mentioned ingredients.

The N-vinylcarbazole homopolymer and N-vinylcarbazole copolymers can be prepared by application of one of the various known polymerization procedures, e.g., by pearl-or emulsion polymerization or by polymerization in solution, wherein the initiation of the polymerization can occur by free radicals, by ion formation, or by radiation, e.g., with actinic light. It is to be noted that the polymerization degree is not critical and can vary between wide limits. As far as the copolymers are concerned it is further to be noted that the content of N-vinylcarbazole units can vary between wide limits, say, e.g., between 20 and 95%. In general, the best results are attained with copolymers having a content of vinylcarbazole units between 40 and 90%.

The spiropyran compound(s) are preferably used in admixture with a photosensitive lower $C_1$ polyhaloalkane, e.g., carbon tetrabromide and iodoform in a weight ratio of 1:1 to 1:20.

Each of N-vinylcarbazole, furan and the described furan derivative is preferably used in a weight ratio of 1:3 to 1:10 with respect to the photosensitive polyhalogen compound. The 1-phenyl-3-pyrazolidinone, benzalphenylhydrazone or 2,3-dimethyl-1-phenyl-5(2)-pyrazolone are preferably also used in a weight ratio of 1:3 to 1:10 with respect to the photosensitive polyhalogen compound. Mixtures of different compounds of each of the classes (1), (2), and (4) to (6) are not excluded. In a preferred recording material a 1:1 by weight mixture of carbon tetrabromide and iodoform is used.

In order to diminish the rate of spontaneous thermal colour formation over long periods of time as may be encountered during storage of the photograhic material and heat-fixing of the photographic materials so-called "anti-foggants" may be added to the photosensitive composition. Suitable anti-foggants include triaryl compounds of group Vb elements, e.g., triphenylstibine. Triphenylstibine and analogous compounds suited for that purpose are described in the United Kingdom Pat. No. 1,071,104.

A dry photographic coating containing the above mentioned ingredients may be formed by first dissolving the binding agent(s) in a suitable inert solvent, which acts as dispersing or dissolving medium for the other ingredients added subsequently and is removed from the coating composition by evaporation so that a solid photograhic recording layer is left on a properly chosen support. The supports may be of any kind encountered in silver halide photographic materials, e.g., paper and film supports.

The image-wise exposure is effected with ultraviolet radiation, e.g., of a high pressure mercury vapor bulb.

The stabilization of the obtained prints may proceed by washing off the residual photosensitive organic polyhalogen compound with a suitable solvent or solvent mixture, e.g., a hydrocarbon liquid such as petroleum ether optionally mixed with acetone, or by simply evaporating it by raising the temperature when the compound involved is sufficiently volatile. For its relatively high volatility and high photosensitivity carbon tetrabromide or a mixture of carbon tetrabromide and iodoform are preferred. The heating proceeds preferably at a temperature above 100° C, e.g., in the range of 100° to 200° C.

Apart from the fact that the overall heating of the image-wise exposed recording material results in its stabilization against a further exposure the print-out image obtains an increase in density in the three primary color spectral regions (red, green and blue) and becomes deep black.

The present invention is illustrated by the following examples without, however, limiting it thereto. The ratios and percentages are by weight unless otherwise indicated.

EXAMPLE 1

A coating solution containing the following ingredients was prepared:

| | |
|---|---|
| carbon tetrabromide | 100 mg |
| iodoform | 100 mg |
| 3-methyl-di-β-naphthospiropyran | 100 mg |
| furylacrylic acid | 50 mg |
| N-vinylcarbazole | 50 mg |
| 1-phenyl-3-pyrazolidinone | 50 mg |
| triphenylstibine | 20 mg |
| 10% solution of poly-N-vinylcarbazole in methylene chloride | 4 ml |
| 1,2-dichloroethylene | 4 ml |

The obtained coating solution was applied at a wet coating thickness of 0.1 mm to a non-subbed polyethylene terephthalate support and dried in the dark at 50° C.

The obtained recording material was contact-exposed through a test chart with a 80 W high pressure mercury vapour lamp, HP-80W (trade name of Philips' Gloeilampenfabrieken N.V. — The Netherlands) placed at a distance of 10 cm and operating with an exposure time of 40 s. Thereupon the exposed material was heated for 5 min at 180° C.

Spectral density values were determined behind colored filters A, B, C and D respectively having a transmission curve [(% transmission (T) versus wavelength (nm)] as shown in the accompanying figure. The results are listed in the following Table 1.

Table 1

| Filter | Spectral Density |
|---|---|
| A (Wratten filter 106) | 1.62 |
| B (Wratten filter 92) | 1.52 |
| C (Wratten filter 93) | 1.64 |
| D (Wratten filter 94) | 1.58 |

EXAMPLE 2

When in the recording layer composition of Example 1 a same weight proportion of furan instead of furylacrylic acid was used the following spectral density results listed in Table 2 were obtained.

Table 2

| Filter | After 5 min heating at 180° C Spectral Density |
|---|---|
| A | 1.59 |
| B | 1.50 |
| C | 1.60 |
| D | 1.53 |

EXAMPLE 3

When in the recording layer composition of Example 1 a same weight proportion of 2-carboxyfuran instead of furylacrylic acid was used the following spectral density results listed in Table 3 were obtained.

Table 3

| Filter | After 5 min heating at 180° C Spectral Density |
|---|---|
| A | 1.55 |
| B | 1.44 |
| C | 1.64 |
| D | 1.49 |

EXAMPLE 4

When in the recording layer composition of Example 1 a same weight proportion of benzalphenylhydrozone instead of 1-phenyl-3-pyrazolidinone was used substantially the same result was obtained.

EXAMPLE 5

When in the recording layer composition of Example 1 a same weight proportion of 2,3-dimethyl-1-phenyl-5(2)-pyrazolone instead of 1-phenyl-3-pyrazolidinone was used substantially the same result was obtained.

The omission of 1-phenyl-3-pyrazolidinone, benzylphenylhydrazone or 2,3-dimethyl-1-phenyl-5(2) pyrazolone from the recording layer composition resulted in a density drop of at least 30% behind the visual (A), red (B), green (C) and blue (D) filter.

We claim:

1. A photographic material containing in a layer on a support a mixture of the following compounds:

1. at least one ultraviolet-sensitive organic polyhalogen compound capable of producing a dye salt with a spiropyran compound on exposure with ultraviolet radiation,
2. at least one spirobi(arylpyran) compound,
3. N-vinylcarbazole,
4. at least one compound selected from the group consisting of furan, furylacrylic acid and 2-carboxyfuran,
5. at least one compound selected from the group consisting of 1-phenyl-3-pyrazolidinone, benzalphenylhydrazone and 1,5-dimethyl-2-phenyl-4-pyrazolin-3-one, and
6. a polymeric compound containing N-vinylcarbazole units.

2. A photographic material according to claim 1, containing as organic polyhalogen compound carbon tetrabromide and/or iodoform.

3. A photographic material according to claim 1, wherein the layer contains as sole binding agent poly-N-vinylcarbazole.

4. A photographic material according to claim 1, wherein the spirobi(arylpyran) compound is 3-methyl-di-β-naphthospiropyran.

5. A photographic material according to claim 1, wherein the layer contains triphenylstibine as an anti-foggant.

6. A photographic material according to claim 1, wherein the spiropyran is present in admixture with a photo-sensitive $C_1$-polyhaloalkane in a weight ratio of 1:1 to 1:20.

7. A photographic material according to claim 1, wherein N-vinylcarbazole is present in a weight ratio of 1:3 to 1:10 with respect to the photosensitive polyhalogen compound.

8. A photographic material according to claim 1, wherein furan, 2-carboxyfuran for furylacrylic acid is present in a weight ratio of 1:3 to 1:10 with respect to the photosensitive polyhalogen compound.

9. A photographic material according to claim 1, wherein 1-phenyl-3-pyrazolidinone, benzylphenylhydrazone or 1,5-dimethyl-2-phenyl-4-pyrazolin-3-one is present in a weight ratio of 1:3 to 1:10 with respect to the photosensitive polyhalogen compound.

10. A photographic process in which a photographic material containing in a layer on a support a mixture of the following compounds:

1. at least one ultraviolet-sensitive organic polyhalogen compound capable of producing a dye salt with a spiropyran compound on exposure with ultraviolet radiation,
2. at least one spirobi(arylpyran) compound,
3. N-vinylcarbazole,
4. at least one compound selected from the group consisting of furan, furylacrylic acid and 2-carboxyfuran,
5. at least one compound selected from the group consisting of 1-phenyl-3-pyrazolidinone, benzalphenylhdrazone and 1,5-dimethyl-2-phenyl-4-pyrazolin-3-one, and
6. a polymeric compound containing N-vinylcarbazole units, is image-wise exposed to ultraviolet radiation of an intensity sufficient to produce a print-out image and the exposed material is heated to stabilize the image and to increase its spectral density in the three primary colour spectral regions.

11. A photographic process according to claim 10, wherein heating proceeds in the range of 100° to 200° C.

* * * * *

UNITED STATES PATENT AND TRADEMARK OFFICE

CERTIFICATE OF CORRECTION

PATENT NO. : 4,028,108

DATED : June 7, 1977

INVENTOR(S) : Freddy Ghisleen Van Royen

It is certified that error appears in the above-identified patent and that said Letters Patent are hereby corrected as shown below:

In the Claims:

Claim 8, line 2, "for" should read -- or --.

Signed and Sealed this

*twenty-third* Day of *August 1977*

[SEAL]

*Attest:*

RUTH C. MASON
*Attesting Officer*

C. MARSHALL DANN
*Commissioner of Patents and Trademarks*